United States Patent [19]

Asbury

[11] 3,951,382

[45] Apr. 20, 1976

[54] AUTOMATIC CARPET KICKER

[76] Inventor: Charles T. Asbury, 717 Isle of Palms, Ft. Lauderdale, Fla. 33301

[22] Filed: Aug. 21, 1975

[21] Appl. No.: 606,466

[52] U.S. Cl. ..... 254/62
[51] Int. Cl.[2] ..... A47G 27/04
[58] Field of Search ..... 254/57–63

[56] References Cited

UNITED STATES PATENTS

| | | | |
|---|---|---|---|
| 834,535 | 10/1906 | Poirot | 254/57 |
| 3,022,979 | 2/1962 | Dahlke | 254/62 |
| 3,311,347 | 3/1967 | Thompson | 254/57 |
| 3,572,800 | 3/1971 | Graziana | 254/57 |
| 3,693,936 | 9/1972 | Payson | 254/62 |
| 3,791,624 | 2/1974 | Payson | 254/62 |

FOREIGN PATENTS OR APPLICATIONS

| | | | |
|---|---|---|---|
| 403,961 | 7/1968 | Australia | 254/57 |

*Primary Examiner*—Al Lawrence Smith
*Assistant Examiner*—Robert C. Watson
*Attorney, Agent, or Firm*—Oltman and Flynn

[57] ABSTRACT

An automatic carpet kicker having a spring-propelled carpet-engaging head that is retractable by a foot-operated mechanical linkage.

21 Claims, 18 Drawing Figures

FIG. 18
FIG. 8
FIG. 17
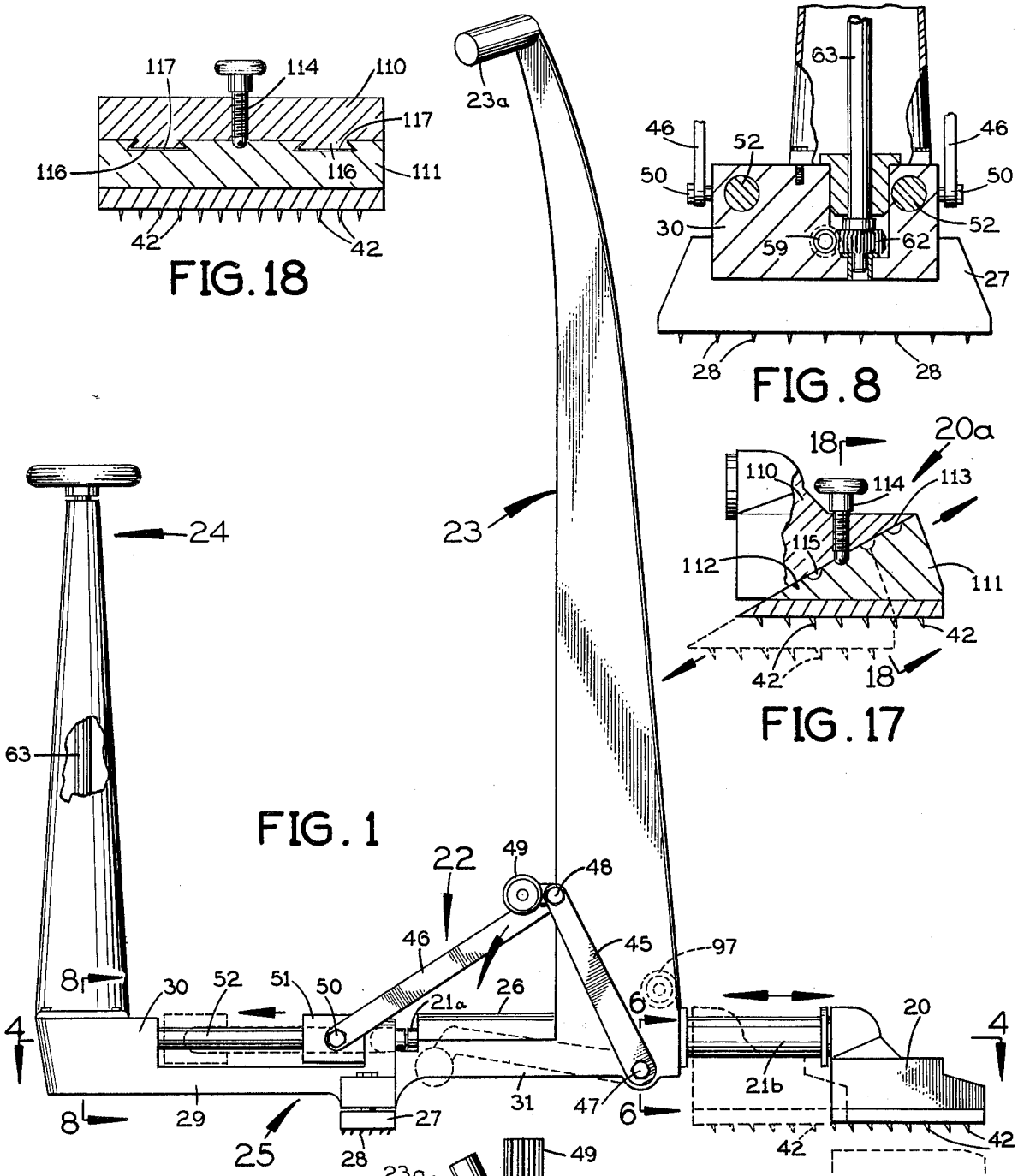
FIG. 1
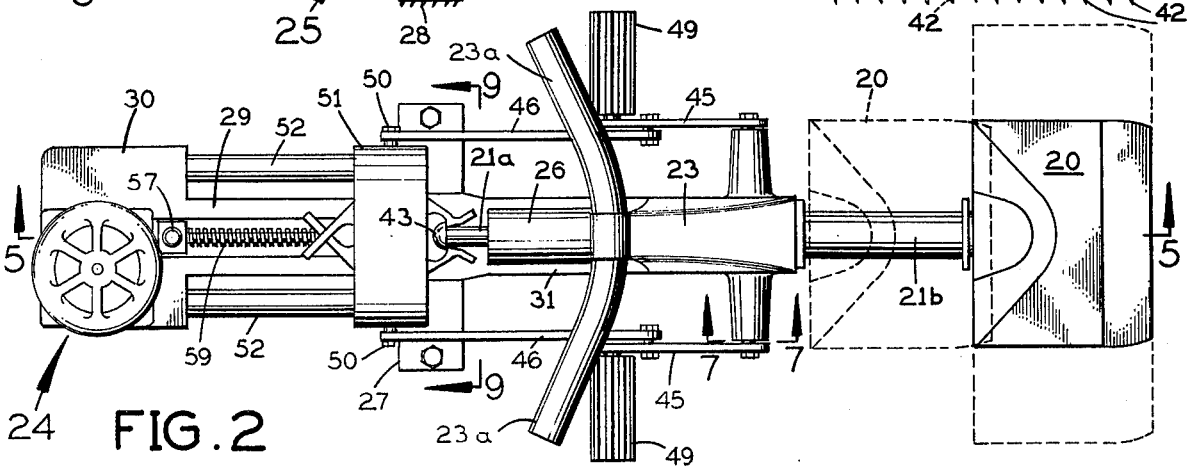
FIG. 2

AUTOMATIC CARPET KICKER

BACKGROUND OF THE INVENTION

In the installation of wall-to-wall carpet, the conventional practice has been to use a carpet "kicker" having a carpet-engaging head at one end with a plurality of downwardly and forwardly inclined teeth on the bottom. The opposite end of the carpet kicker has a rearwardly-facing pad which the installer strikes with his knee to drive the kicker forward, so as to force the carpet snugly against the adjacent wall. This operation can be damaging to the installer's knee, possible disabling him after a period of time or, if not that, discouraging him from continuing this strenuous and hazardous type of work.

SUMMARY OF THE INVENTION

The present invention is directed to a novel and improved, automatic carpet kicker which overcomes these disadvantages.

In accordance with the presently-preferred embodiment of the present invention, the carpet-engaging head is attached to a horizontally reciprocable plunger which is retracted by a foot-operated linkage that has an appreciable mechanical advantage. At the completion of its retraction stroke, the plunger is released automatically and is propelled forward by a spring, carrying with it the carpet-engaging head which operates on the carpet in the same manner as in the previous knee-operated carpet kickers. The apparatus has an upstanding handle at the front which the carpet installer holds while moving the apparatus to different locations on the carpet and while operating the apparatus. Preferably, the length of the retraction and forward strokes of the carpet-engaging head in the apparatus is selectively adjustable by the user.

Preferably, also, the apparatus has an attachment for pressing the edge of the carpet down onto the usual fastening strip on the floor next to the wall.

A principal object of this invention is to provide a novel and improved carpet kicker.

Another object of this invention is to provide such a carpet kicker whose proper use does not entail the risk of bodily damage to the carpet installer.

Another object of this invention is to provide a novel mechanically-operated carpet kicker which retains the advantages of previously used knee-operated carpet kickers.

Another object of this invention is to provide a novel spring-powered carpet kicker with a retraction linkage that has a substantial mechanical advantage adapting it for easy operation by the user's foot.

Another object of this invention is to provide such a carpet kicker with a carpet press-down attachment for fastening the carpet along the edge to the usual fastening strip on the floor next to the wall. Further objects and advantages of this invention will be apparent from the following detailed description of a presently-preferred embodiment thereof, which is shown in the accompanying drawings, in which:

FIG. 1 is a side elevational view of the present apparatus showing the carpet-engaging head in its forward or extended position in full lines and in its retracted position in phantom lines;

FIG. 2 is a top plan view of the FIG. 1 apparatus;

FIG. 8 is a fragmentary vertical cross-section taken along the line 8—8 in FIG. 1 at the stroke-adjusting mechanism in the apparatus;

FIG. 17 is a view, partly in elevation and partly in longitudinal section, showing a height adjustment for the carpet-engaging head; and FIG. 18 is a vertical cross-section taken along the line 18—18 in FIG. 17.

Figure 3:
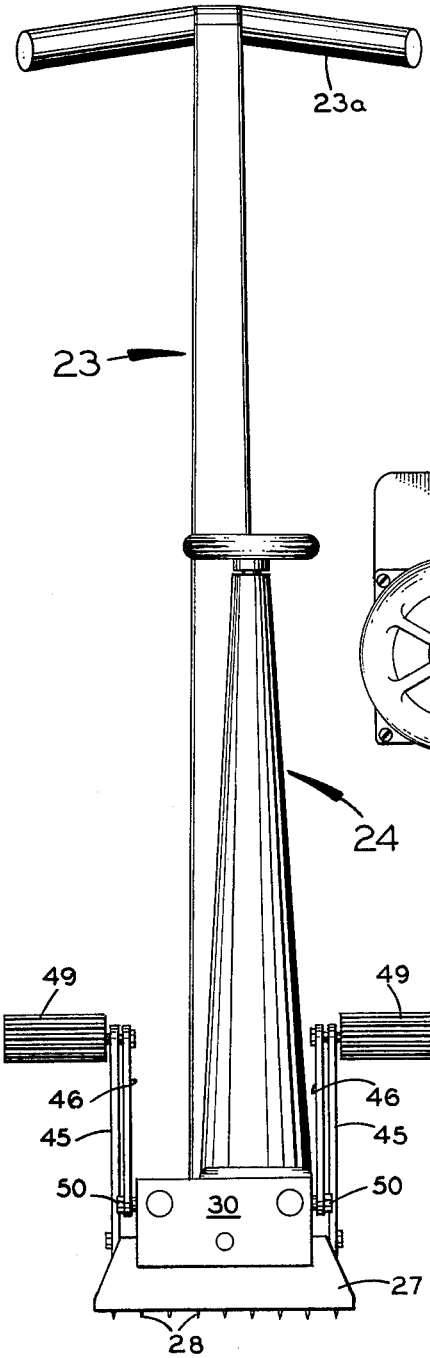
FIG. 3 is a rear elevational view of the apparatus.

Referring first to FIG. 1, in broad outline the present apparatus includes a toothed, carpet-engaging head 20 of known design, a horizontally reciprocable plunger 21 connected to the carpet-engaging head, a foot-operated linkage 22 for retracting the plunger 21, a spring (to be described later) for impelling the plunger 21 through its forward, carpet-stretching stroke, a rigid, upstanding front handle 23 for manipulating the apparatus, a handle 24 at the back for adjusting the stroke of the plunger 21 and the carpet-engaging head 20, and a rigid, generally horizontal base 25 at the bottom.

The base 25 carries on top a horizontal cylinder 26 extending rearwardly from the lower end of the upstanding front handle 23. The plunger 21 is reciprocable in this cylinder, as described in detail hereinafter.

Figure 4:
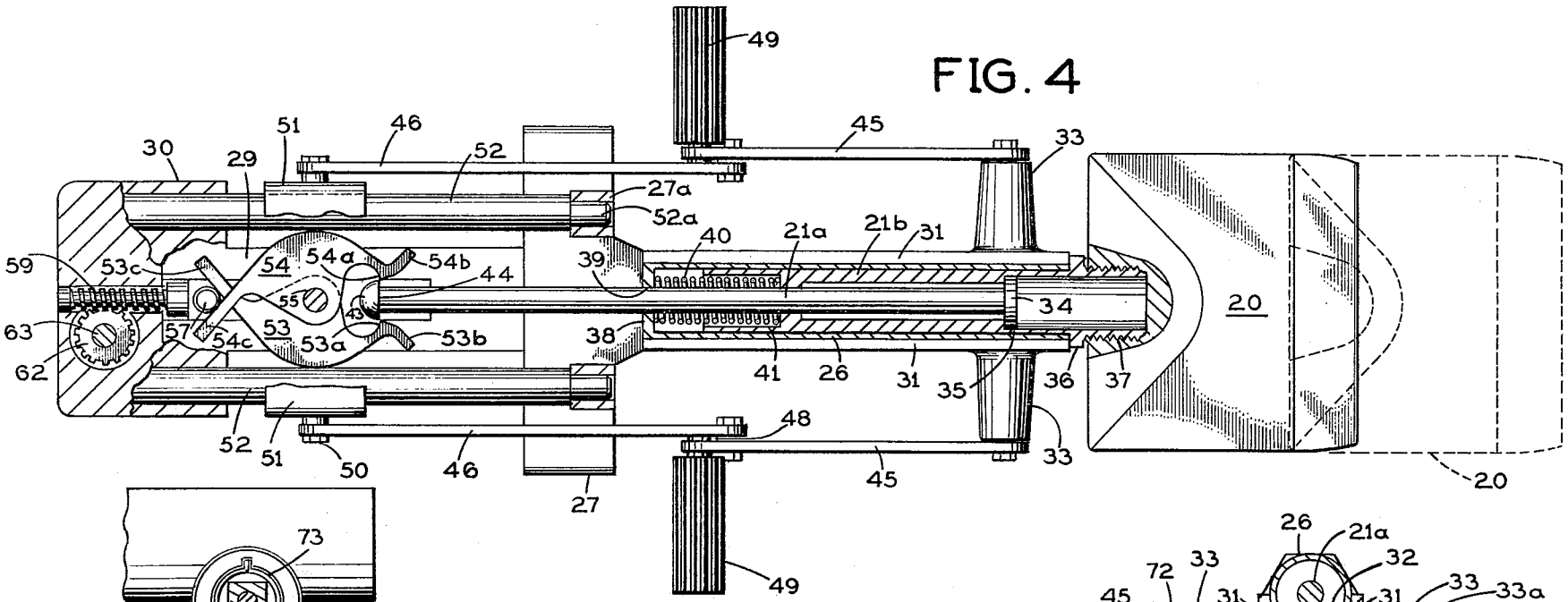
FIG. 4 is a horizontal longitudinal sectional view taken along the line 4—4 in FIG. 1 and in full lines showing the carpet-engaging head retracted and in phantom lines showing it extended.

A short distance behind the cylinder 26 (to the left in FIG. 1), the base 25 has a downwardly-extending foot 27 with rearwardly and downwardly inclined teeth 28 on the bottom for engagement with the carpet. As shown in FIGS. 2, 3 and 4, this foot 27 extends a substantial distance transversely on either side of the cylinder to provide a stable, carpet-gripping support for the apparatus. The base 25 has a horizontal longitudinal segment 29 which extends rear-ward from its carpet-engaging foot 27. At the back end of this horizontal segment 29 the base presents an upstanding, transversely enlarged segment 30 located below the back handle 24.

Figure 6:
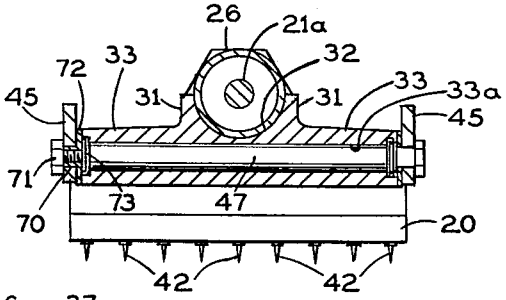
FIG. 6 is a fragmentary vertical cross-section taken along the line 6—6 in FIG. 1 at the fixed pivot for the retraction linkage.

As shown in FIGS. 4 and 6, the cylinder 26 rests on top of a horizontally elongated, longitudinally extending yoke segment 31 of the base, which presents a semi-cylindrical, upwardly-facing recess 32 (FIG. 6) in which the cylinder 26 is seated. This yoke segment 31 of the base extends forward from the foot 27, and near its front end it carries a hollow cross arm 33 projecting horizontally on either side. This cross arm has a horizontal bore 33*a* (FIG. 6).

The plunger 21 comprises an inner rod 21*a* (FIG. 4) and an outer sleeve 21*b* that is disposed concentrically on the rod 21*a* and is slidable in the cylinder 26. At its front end the rod 21*a* carries an enlarged transverse head 34, which abuts against a forwardly-facing, transverse, annular shoulder 35 on the inside of sleeve 21*b*. The sleeve 21*b* also has a transverse, radially outwardly projecting, annular collar 36 located directly behind the carpet-engaging head 20. Forward from this shoulder the sleeve 21*b* presents an externally screw-threaded front end segment 37 which is threadedly received in a complementary screw-threaded recess formed in the back end of the carpet-engaging head 20.

The cylinder 26 has an inwardly-extending, transverse end wall 38 at its back end (the left end in FIG. 4). This end wall has a central opening 39 through which the plunger rod 21*a* extends slidably. A coil spring 40 is engaged under compression between the cylinder end wall 38 and a radially inwardly extending transverse, annular wall 41 on the inside of the plunger sleeve 21*b*. The spring 40 urges the plunger sleeve 21*b* forward along the cylinder 26, and the engagement of the forwardly-facing internal shoulder 35 on the plunger sleeve 21*b* against the head 34 on the plunger rod 21*a* causes this spring force to be applied to the plunger rod, also. Spring 40 provides the motive power for pushing the carpet-engaging head 20 forward from the full-line, retracted position to the phantom-line, extended position in FIG. 5.

Figure 5:
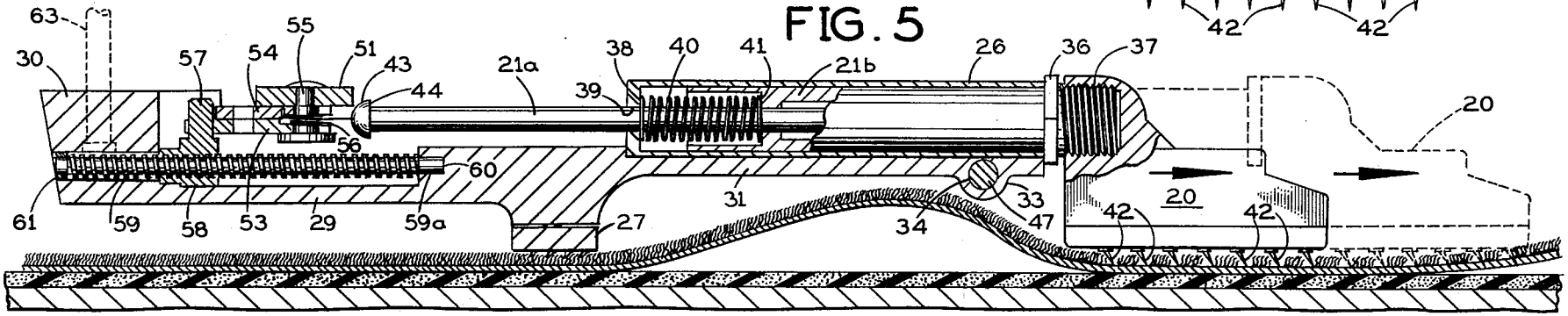
FIG. 5 is a vertical longitudinal section taken along the line 5—5 in FIG. 2, showing the carpet-engaging head retracted in full lines and extended in phantom lines.
Figure 7:
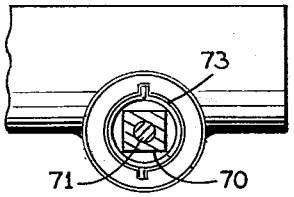
FIG. 7 is a fragmentary vertical longitudinal section taken along the line 7—7 in FIG. 2 at this same pivot.

Normally, the spring 40 forces the plunger assembly 21b, 21a forward along the cylinder 26 so that the carpet engaging head 20 will be in the phantom-like position in FIGS. 4 and 5, several inches in front of the cylinder 26.

The carpet-engaging head 20 is of known construction, presenting a plurality of downwardly and forwardly inclined, pointed teeth 42 on the bottom. During a forward stroke of the head 20, these teeth bite into the carpet and carry it forward substantially in unison with the head. When the head 20 is retracted, the inclination of these teeth enables them to slide back over the carpet without pulling the carpet back with the head 20.

The plunger rod 21*a* extends rearwardly beyond the back end wall 38 of cylinder 26, and at its back end it presents an enlarged head 43 with a rounded back face and a forwardly-facing, radially disposed, annular shoulder 44 at the front.

The front handle 23 is rigidly attached to the front end of the base 25 and it extends upward therefrom more or less vertically. A handle bar 23*a* on the upper end of the front handle is located approximately three feet above the floor, at a level convenient for the user to hold when moving the apparatus to the desired location on the carpet and when holding the apparatus steady during a carpet-kicking operation.

The linkage 22 for retracting the carpet-engaging head 20 and the plunger assembly 21*a*, 21*b*, comprises a pair of rigid front linkage arms 45 and a pair of rigid back linkage arms 46, with the linkage arms of each pair being disposed respectively on opposite sides of the cylinder 26, as shown in FIGS. 2 and 4.

The front linkage arms 45 are connected at their lower front ends to a horizontal cross pin 47 which is rotatably received in the bore 33*a* of the front cross arm 33 on the base 25 of the apparatus. This provides a fixed horizontal pivot for the lower front end of the linkage.

As shown in FIG. 6, at each end the cross pin 47 has a reduced extension 70 of square or other polygonal cross-section which is snugly received in a complementary opening in the lower end of the adjacent front linkage arm 45. This end 70 of the cross pin has a screw-threaded, outwardly facing recess which threadedly receives the inner end of a corresponding clamping screw 71 having a polygonal head on its outer end which abuts against the outside of the respective front linkage arm 45 to clamp that linkage arm to the cross pin 47. A flat annular washer 72 is engaged between the inside of each front linkage arm 45 and the adjacent end face of the cross arm 33 on the base 25 of the apparatus.

At each end of the cross pin 47 a respective torsion spring 73 acts between the cross arm 33 of the base and the cross pin 47 to bias the cross pin clockwise in FIG. 1, thereby biasing the entire linkage 22 to the position shown in FIG. 1.

The upper back ends of the front linkage arms 45 are pivotally connected by respective cross pins at 48 to the upper front ends of the back linkage rods 46. At each of these locations a respective foot pedal 49 is connected rigidly to the upper end of the corresponding front linkage rod 45. As shown in FIGS. 2 and 4, these foot pedals extend horizontally outward from the linkage on either side.

Figure 9:
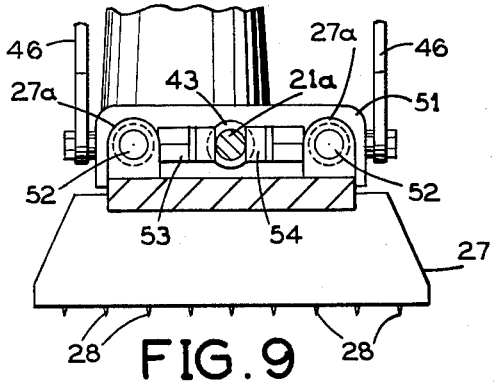
FIG. 9 is a fragmentary vertical cross-section taken along the line 9—9 in FIG. 2, showing in end elevation the automatically releasable clamping mechanism associated with the retraction linkage.

The lower rear ends of the back linkage arms 46 are pivotally connected at 50 to a cross piece 51, which extends transversely between the two sets of linkage arms. This cross piece 51 is slidably mounted on a laterally spaced pair of longitudinally extending, horizontal guide rods 52. These guide rods are rigidly mounted at their respective back ends in the upstanding back end segment 30 of the base 25 of the apparatus. The guide rods 52 have reduced front ends 52*a* (FIG. 4) which are received in respective upwardly extending projections 27*a* (FIG. 9) on the foot segment 27 of base 25.

With this arrangement, when the user steps down on either foot pedal 49, the front linkage arms 45 move down counterclockwise in FIG. 1 about their fixed pivot at 47, the rear linkage arms 46 are forced rearward, and the cross piece 51 is pushed rearward horizontally along the guide rods 52 from the full-line position to the phantom-line position in FIG. 1.

Figure 11:
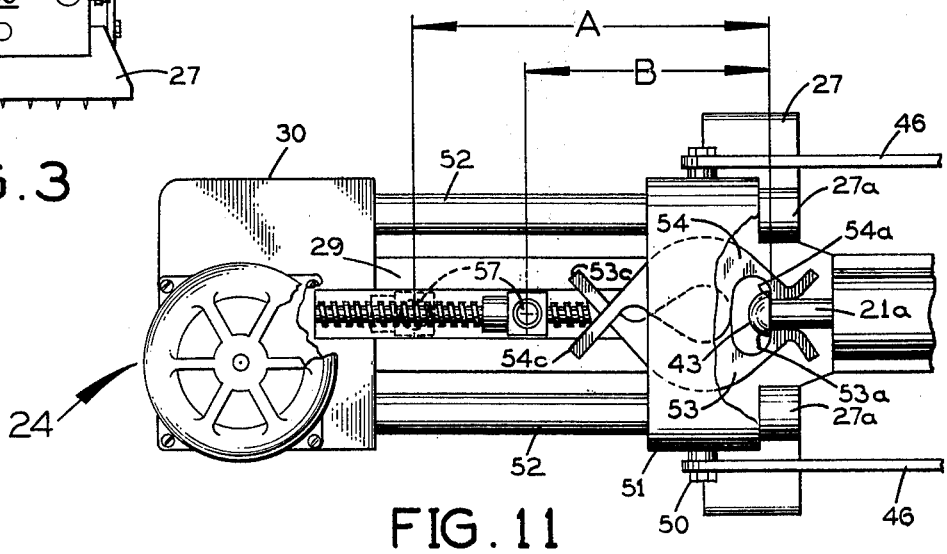
FIG. 11 is a similar view showing the position of these parts after clamping engagement has taken place and before the carpet-engaging head is retracted.

The retractable cross piece 51 carries a gripper or clamp for grasping the rear head 43 on the plunger rod 21a to retract the plunger 21*a*, 21*b* along the cylinder 26 when the linkage 45–51 is operated as just described. As best seen in FIG. 4, this clamp has a pair of opposite arms 53 and 54 which are pivoted to each other at a vertical pivot pin 55 carried by the cross piece 51 at a location about midway along the length of each arm. Forward of this pivot the arms present respective rearwardly-facing, transverse, internal shoulders 53*a* and 54*a* for locking engagement with the forwardly-facing radial, annular shoulder 44 on the head 43 of the plunger rod 21*a*, as shown in FIG. 11. The two arms 53 and 54 are cut away behind these shoulders 53*a* and 54*a* to accommodate the plunger rod head 43 when such locking engagement takes place. Forward of these locking shoulders 53*a*, 54*a*, the two clamp arms are inclined outward away from each other at their respective front end segments 53*b* and 54*b*.

As shown in FIG. 5, a torsion spring 56 acts between the two pivoted arms 53, 54 of the clamp to bias their front ends toward each other to engage the plunger rod head 43. If desired this torsion spring may be replaced by a coil spring engaged under compression between the clamp arms 53, 54 behind the pivot pin 55.

As best seen in FIG. 4, at their back ends 53*c* and 54*c* the two clamp arms cross over one another. An upstanding post 57 is positioned in axial alignment with the clamp pivot pin 55 for engagement by the back ends 53*c* and 54*c* of the clamp arms when the cross piece 51 is retracted. As such retraction continues, this post spreads apart the clamp arms, pivoting the clamp arm 53 clockwise and pivoting the clamp arm 54 counterclockwise in FIG. 4 to thereby release the plunger rod head 43 from these clamp arms. When this action takes place, the compressed spring 40 forces the plunger 21*a*, 21*b* forward to displace the carpet-engaging head 20 forward from the full line position to the phantom line position in FIGS. 4 and 5.

The clamp-releasing post 57 may have a fixed axial position but in the preferred embodiment shown it is adjustably positioned so that the length of the stroke of the carpet-engaging head 20 is adjustable. In this arrangement, referring to FIGS. 4 and 5, the post 57 is integrally attached to a nut 58, which is threadedly mounted on a horizontal lead screw 59. This lead screw extends longitudinally of the base 25, with its front end 59*a* rotatably received in a cylindrical, rearwardly-facing opening 60 (FIG. 5) in the base a short distance behind the carpet-engaging foot 27. The rear end of the lead screw is rotatably received in a cylindrical bushing 61 carried by the upstanding back end segment 30 of the base. The lead screw is threadedly engaged by a pinion 62 (FIG. 4) on the lower end of a rotable vertical shaft 63. The upper end of this shaft is attached to a hand wheel 64 (FIG. 1) at the upper end of the back handle 24. The vertical shaft 63 extends down through a casing 65, which extends up from the back end segment of the base 25. By turning the hand wheel 64, the axial position of the release post 57 can be adjusted to thereby adjust the length of the retraction and forward strokes of the carpet-engaging head 20.

In the operation of the apparatus as thus far described, the carpet installer turns the hand wheel 64 to adjust the clamp-releasing post 57 longitudinally to the desired position which determines the length of the retraction and forward strokes of the carpet-engaging head. For example, if the release post is adjusted to the position shown in full lines in FIG. 11, the retraction stroke of the plunger will be limited to the distance B in that Figure. However, if post 57 is set at the phantom-line position in FIG. 11, the maximum stroke length A will be provided.

Initially, the torsion springs 73 bias the retraction linkage 22 to the position shown in full lines in FIG. 1, in which it positions the cross piece 51, as shown in FIG. 2, so that the spring-biased pivoted clamp arms 53, 54 which it carries are in locking engagement with the head 43 on the back end of the plunger rod 21*a*. At the same time, the spring 40 biases the plunger 21*a*, 21*b* and the carpet-engaging head forward to the extended position shown in full lines in FIGS. 1 and 2.

When the carpet installer steps down on either foot pedal 49, the linkage 22 pivots about the fixed pivot 47 at the lower front end of its front linkage arms 45, forcing the cross piece 51 rearwardly. The clamp arms 53, 54 maintain their locking engagement with the plunger head 43 so that the plunger rod 21*a* and the plunger sleeve 21*b* are retracted in unison with the cross piece 51, further compressing the spring 40 inside the cylinder 26. The carpet-engaging head 20 is retracted in unison with the plunger 21*a*, 21*b* to the phantom line position in FIGS. 1 and 2.

When the back end of the clamp arms 53, 54 reach the release post 57 they are progressively spread apart (FIG. 4) until they release the plunger head 43.

When this happens, the spring 40 forces the plunger rod 21*a*, the plunger sleeve 21*b* and the carpet-engaging head 20 forward. The teeth 42 of head 20 dig into the carpet and force it forward from the full-line position in FIG. 5 to the phantom-line position in that Figure, flattening the carpet and stretching it slightly so that it is forced snugly against the adjacent baseboard of the wall. The action of the carpet-engaging head 20 during this spring-powered forward stroke is essentially similar to the action which takes place when a conventional carpet kicker is struck by the installer's knee.

However, when the present apparatus is used the installer is not required to strike it with his knee. Instead, he uses his foot to retract the carpet-engaging head, acting through the appreciable mechanical advantage provided by the mechanical linkage 22, and at the completion of the retraction stroke the plunger is released automatically and is driven forward by the spring 40. Thus, there is no appreciable bodily wear and tear on the installer, and particularly on such a vulnerable part of the body as the knee. The installer preferably stands substantailly erect when operating this apparatus so that it is less tiring to him over a period of time. Also, he should be able to "kick" the entire carpet into place along each wall of the room using the present apparatus at least as quickly as he can do so using the conventional knee-operated carpet kicker.

Figure 10:
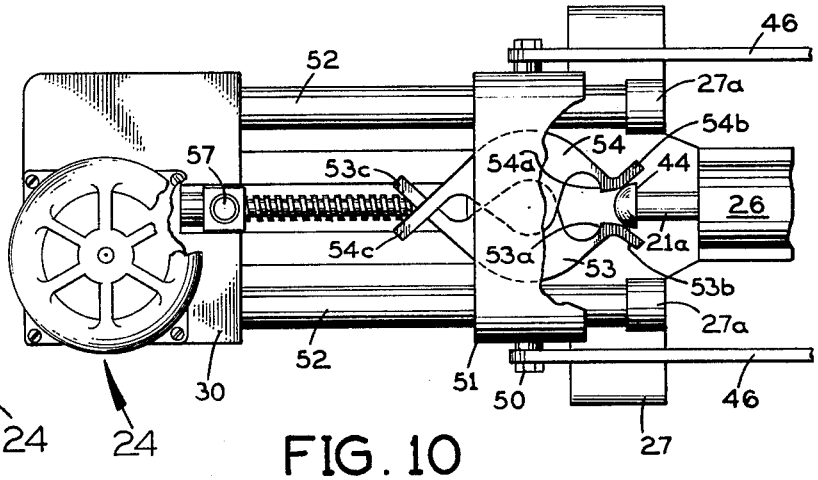
FIG. 10 is a fragmentary top plan view showing this clamping mechanism just before its clamping engagement with the plunger rod as the retraction linkage is returned to its normal position.

When the carpet installer releases the foot pedal 49 which he had just depressed, the torsion springs 73 return the linkage 22 to the FIG. 1 position. Near the end of this spring return of the linkage, as shown in FIG. 10, the inclined front end segments 53*b* and 54*b* of the clamp arms 53 and 54 ride over the rounded back end face of the head 43 on the plunger rod 21*a* and are apread apart by the latter until they snap into locking engagement with the plunger rod head, as shown in FIG. 11, at which time the rearwardly facing internal shoulders 53*a* and 54*a* on these clamp arms engage the forwardly-facing radial shoulder 44 on the plunger rod head.

Figure 16:
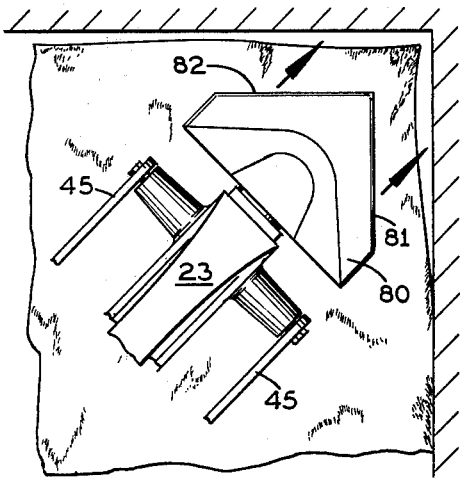
FIG. 16 is a fragmentary top plan view showing a modified carpet-engaging head on the present apparatus which is designed for installation of the carpet in the corner of a room.

As shown in FIG. 16, for installing the carpet in a corner of the room the carpet-engaging head 20 may be replaced by a modified head 80 having adjoining side edges 81, 82 at the front which intersect at right angles. This modified head 80 is secured to the reciprocable plunger of the present apparatus and is retracted and advanced in the same manner as has been described for the conventional carpet-engaging head 20.

FIGS. 12–15 show an attachment on the present carpet kicker for the purpose of fastening down the edge of the carpet.

Figure 12:
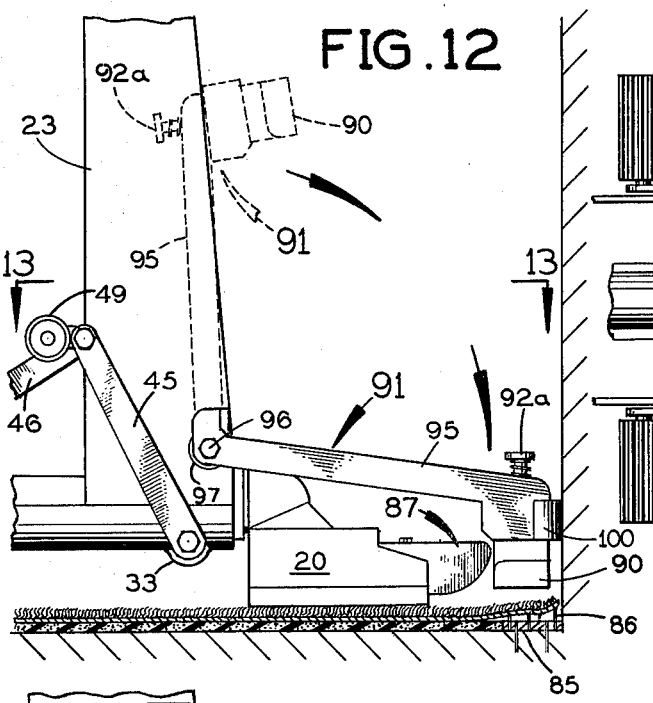
FIG. 12 is a fragmentary side elevational view of the apparatus having the carpet press-down attachment on the front.
Figure 13:
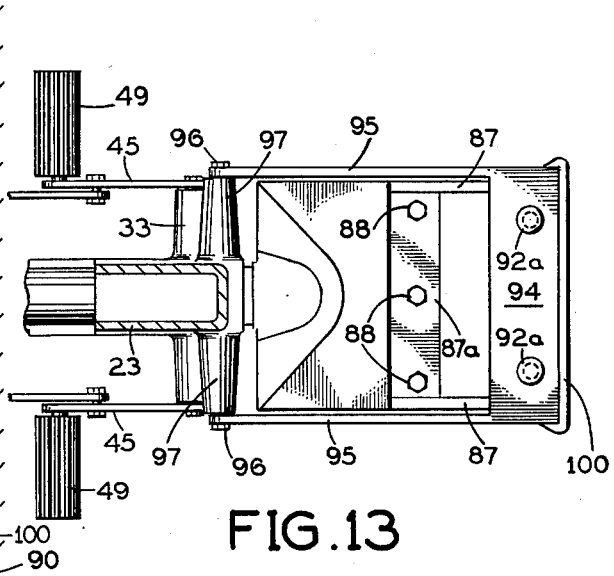
FIG. 13 is a fragmentary plan view looking down on this press-down attachment from the line 13'13 in FIG. 12.

As shown in FIG. 12, in a typical installation a wooden strip 85 is fastened to the floor along each wall, and this strip has a series of upwardly-projecting, pointed nails 86 for engagement with the bottom of the carpet. For facilitating this attachment, two pads 87 of hard rubber or other suitable material are attached to the front of the carpet-engaging head 20 of the present carpet kicker. As shown in FIG. 13, these two pads are attached to a connecting piece 87*a*, extending across the top of the head 20 from side to side and bolted to the latter by bolts 88. Each pad 87 has a convex curvature along its bottom front edge 89 for wedging engagement with a wooden strip 90 which overlies the carpet next to this edge.

If desired, the carpet press-down attachment may consist of these pads 87, with the strip 90 being unattached. When the carpet-engaging head 20 is moved forward, as already described in detail, the pads 87 wedge the strip 90 down on top of the carpet near the edge to press the carpet here down onto the teeth 86 on the floor strip 85.

However, as shown in FIGS. 12–15, strip 90 may be attached to the carpet kicker, also. In the particular arrangement shown, the strip 90 is carried by a bifurcated holder 91 which is pivoted on the carpet kicker.

Figure 15:
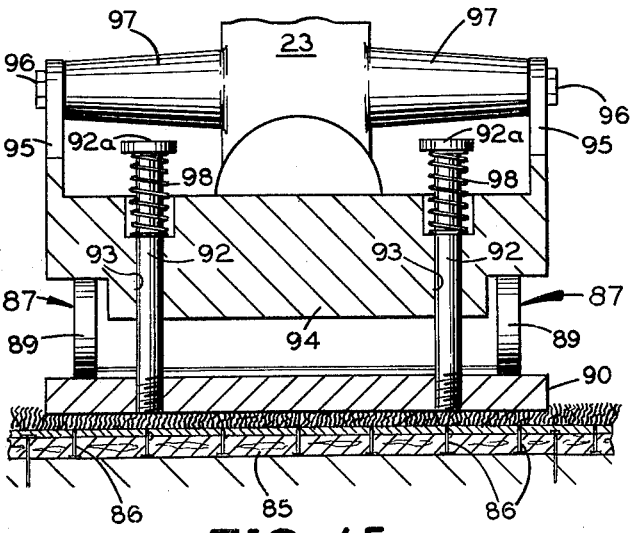
FIG. 15 is a vertical cross-section taken along the line 15—15 in FIG. 14.

As shown in FIG. 15, a pair of vertical posts 92 extend from the strip 90 and pass slidably through corresponding openings 93 formed in a cross piece 94 on the pivoted holder 91. The holder has opposite arms 95 (FIG. 13), which extend from opposite ends of the cross piece 94 to a horizontal pivot at 96 on the lower end of the front handle 23. The pivot pin here extends through a transverse cross arm 97 on the front handle which is located above and slightly in front of the fixed front pivot for the linkage 22 in the carpet kicker.

As shown in FIG. 15, a respective coil spring 98 is engaged under compression between the top of the cross piece 94 and an enlarged head 92*a* on the end of each post 92 away from the strip 90. These springs permit the strip 90 to be displaced downward relative to the holder 91 by the wedging action of the pads 87.

The cross piece 94 carries a resilient pad 100 of soft rubber or the like on the front for engagement with the wall to prevent damage to the wall.

In the use of this arrangement, the holder 91 is dropped down to the position shown in FIG. 12 before the carpet-engaging head 20 is driven forward by spring 40. At this time, the strip 90 carried by this holder is spaced slightly above the carpet or in light contact with it.

Figure 14:
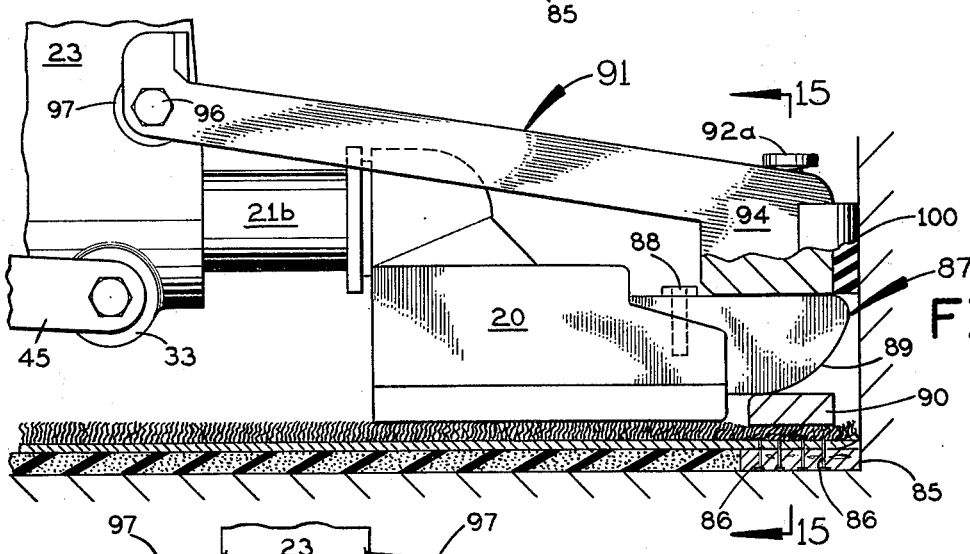
FIG. 14 is a side elevational view, with parts broken away for clarity, showing the press-down attachment in operation.

When the carpet-engaging head 20 is operated, as described, the pads 87 at each end pass underneath the cross piece 94 on the holder 91 and across the top of the strip 90 carried by this holder, forcing this strip down on top of the carpet, as shown in FIG. 14.

When not in use, the holder 91 may be raised about its pivot 96 to the phantom-line position in FIG. 12.

The height of the carpet-engaging teeth 42 may be selectively adjusted, such as by providing the adjustable head construction shown in FIGS. 17 and 18 or by any other suitable arrangement for the same purpose.

Referring to FIG. 17, the head 20a has a top piece 110 and a bottom piece 111 which engage one another along abutting, upwardly and forwardly inclined faces 112 and 113, respectively. A locking screw 114 extends down threadedly through the top piece and is engageable selectively in one of several detent notches 115 formed in the inclined top face 113 of the bottom piece and spaced apart in succession along its length. As shown in FIG. 18, the top piece has a pair of laterally spaced, depending keys 116 which are slidably received in respective keyways 117 extending lengthwise along the inclined top face 113 of the bottom piece 111.

With this arrangement, the bottom piece 111 can be slidably adjusted along the top piece 110 and locked in place by turning down the locking screw 114 into whichever detent notch 115 is then beneath it. Because of the inclination of the abutting faaces 112, 113, such adjustment of the bottom piece 111 lengthwise of the top piece also effects a height adjustment of the bottom piece, so that the capet-engaging teeth are either raised or lowered.

From the foregoing disclosure, it will be evident that my apparatus avoids the bodily hazards and exertions associated with the previous knee-operated carpet kicker. The present apparatus is easily handled and operated with relatively little effort. The adjustability of the stroke length enables the carpet installer to change the operation of the machine for different types of carpets, a shorter stroke being better for relatively fragile carpets whereas a longer stroke may be better for carpets which are more rugged and adapted for more stretching when installed. The press-down attachment on the front is particularly advantageous for the purpose of insuring a proper final placement of the carpet along the edge where it is caught and held by the floor strip with the usual upwardly projecting nails.

It will be evident that various simplifications or elaborations in the design of this apparatus may be made without changing its novel principle of operation. Therefore, it is to be understood that the invention is not limited in its application to the particular arrangement shown.

I claim:

1. In a carpet kicker having a carpet-engaging head, the improvement which comprises:

a base extending behind said head to overlie the carpet;

an elongated plunger slidably reciprocable substantially horizontally along the base through a rearward retraction stroke and a forward stroke;

spring means operatively associated with said plunger to be stressed by the latter's retraction;

mechanical linkage means on said base for retracting said plunger to stress said spring means;

and means for releasing said plunger from said linkage means at the end of its retraction stroke to be propelled forward by said spring means;

said plunger being operatively associated with said carpet-engaging head to impart a forward thrust to the latter when said plunger is propelled forward.

2. A carpet kicker according to claim 1, and further comprising a handle extending up from the support base for manipulating the unitary assembly of the base, head, plunger, spring means and mechanical linkage means as a unit.

3. A carpet kicker according to claim 1, wherein said linkage means includes:

a slide mounted for horizontal reciprocation along the base behind said plunger;

and a clamp on said slide which is engageable with said plunger to retract the latter when the slide is retracted and which is releasable from said plunger at the end of its retraction stroke.

4. A carpet kicker according to claim 3, and further comprising additional spring means biasing said slide and clamp forward along the base for re-engagement of the clamp with said plunger following said forward stroke of the latter.

5. A carpet kicker according to claim 3, wherein:

said clamp comprises pivoted latch means, and spring means biasing said pivoted latch means into into gripping engagement with said plunger;

and said means for releasing said plunger comprises a release member positioned in the retraction path of said clamp to disengage said latch means from said plunger at the completion of the latter's retraction stroke.

6. A carpet kicker according to claim 5, and further comprising means for selectively adjusting the position of said release member along said path to thereby adjust the length of the retraction and forward strokes of said plunger.

7. A carpet kicker according to claim 5, and further comprising additional spring means biasing said slide and clamp forward along the base for re-engagement of said pivoted latch means of the clamp with said plunger following the latter's forward stroke.

8. A carpet kicker according to claim 1, wherein:

said plunger has an enlargement on its rear end away from said carpet-engaging head, said enlargement presenting a forwardly-facing transverse shoulder;

and said linkage means comprises a clamp mounted for horizontal reciprocation behind said plunger and engageable with said forwardly-facing shoulder on the plunger for retracting the plunger;

and said means for releasing said plunger comprises a release member positioned behind said clamp for engagement by the clamp when the latter is retracted to disengage the clamp from said shoulder on the retracted plunger to release the plunger to be propelled forward by said spring means.

9. A carpet kicker according to claim 8, wherein said clamp comprises:

a pivoted arm having a rearwardly-facing internal shoulder in front of the pivot for engaging said forwardly-facing shoulder on the plunger enlargement, and spring means biasing said arm into locking engagement of its internal shoulder against said forwardly-facing transverse shoulder on the plunger enlargement when the plunger is retracted.

10. A carpet kicker according to claim 9, and further comprising means for selectively adjusting the position of said release member along the path of retraction of the clamp to thereby adjust the length of the retraction stroke of the plunger.

11. A carpet kicker according to claim 10, and further comprising additional spring means acting on said linkage to bias said slide and clamp forward for re-engagement of the clamp with said enlargement of the plunger following the latter's forward stroke.

12. A carpet kicker according to claim 1, and further comprising an attachment on the front of said carpet-engaging head projecting forward therefrom to press down a strip which overlies the carpet when said head is drived forward by said plunger.

13. In a carpet kicker having a carpet-engaging head, the improvement which comprises:

a generally horizontal base at substantially the same level as said carpet-engaging head, said base having carpet-engaging means thereon spaced behind said head;

a plunger slidably reciprocable horizontally along said base behind said carpet-engaging head a spring acting on said plunger to drive the latter forward along the base;

said plunger being operatively coupled to said carpet-engaging head to thrust the latter forward when the plunger is driven forward by said spring;

a handle extending up from the base;

a slide supported from the base for horizontal reciprocation behind the plunger in a direction longitudinally of the plunger;

a clamp carried by said slide for movement therewith, said clamp having means for engaging said plunger to retract the plunger when the slide and clamp are retracted;

a mechanical linkage comprising pivotally interconnected, rigid linkage arms acting between the base and the slide, and means for applying a downward force to said linking arms adjacent the pivotal connection between them for extending the linkage to retract the slide and the clamp;

and means positioned along the path or retraction of the clamp for releasing the clamp from the plunger after retraction of the plunger to permit the plunger to be propelled forward by said spring.

14. A carpet kicker according to claim 13, wherein said means for applying a downward force to said linkage arms is a foot pedal.

15. A carpet kicker according to claim 13, and further comprising additional spring means acting on said linkage to urge said slide forward to a position in which said clamp re-engages said plunger following the latter's forward stroke.

16. A carpet kicker according to claim 13, wherein:

said clamp comprises a pivoted arm and spring means biasing said arm into gripping engagement with said plunger;

and said means for releasing the clamp from said plunger comprises a release member positioned in the retraction path of said clamp to pivot said arm out of engagement with said plunger at the completion of the retraction stroke.

17. A carpet kicker according to claim 16, and further comprising means for selectively adjusting the position of said release member along said path to thereby adjust the length of the retraction and forward strokes of said plunger.

18. A carpet kicker according to claim 15, wherein:

said plunger has an enlargement on its rear end away from said carpet-engaging head, said enlargement presenting a forwardly-facing transverse shoulder and a convex back face behind said shoulder;

and said clamp comprises:

a pivoted arm having a rearwardly facing internal shoulder in front of the pivot for engaging said shoulder on the plunger enlargement, said arm in front of said internal shoulder being slidable over said convex back face on the plunger enlargement when moved forward with respect to the plunger to engage its internal shoulder with said shoulder on the plunger enlargement;

and spring means biasing said arm toward said plunger for locking engagement of said internal shoulder against said forwardly-facing transverse shoulder on the plunger enlargement when the plunger is retracted.

19. A carpet kicker according to claim 18, and further comprising means for selectively adjusting the position of said release member along the path of retraction of the clamp to thereby adjust the length of the retraction stroke of the plunger.

20. A carpet kicker according to claim 15, and further comprising an attachment on the front of said carpet-engaging head projecting forward therefrom to press down a strip which overlies the carpet when said head is advanced by said plunger.

21. A carpet kicker according to claim 13, wherein said carpet-engaging head has means for selectively adjusting the depth of penetration of teeth on the bottom of said head.

* * * * *